US006234787B1

(12) United States Patent
Endoh et al.

(10) Patent No.: US 6,234,787 B1
(45) Date of Patent: May 22, 2001

(54) COMBUSTION TYPE HARMFUL SUBSTANCE REMOVING APPARATUS

(75) Inventors: Fumitaka Endoh; Maya Yamada; Shuichi Koseki; Shinichi Miyake; Akihiko Nitta; Yoshiaki Sugimori, all of Yamanashi (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/051,457

(22) PCT Filed: Aug. 11, 1997

(86) PCT No.: PCT/JP97/02800

§ 371 Date: Apr. 13, 1998

§ 102(e) Date: Apr. 13, 1998

(87) PCT Pub. No.: WO98/06977

PCT Pub. Date: Feb. 19, 1998

(30) Foreign Application Priority Data

Aug. 14, 1996 (JP) ..... 8-214699
Oct. 18, 1996 (JP) ..... 8-276217

(51) Int. Cl.[7] ..... F23D 14/46

(52) U.S. Cl. ..... 431/353; 431/5; 431/7; 110/238; 422/168

(58) Field of Search ..... 431/3, 7, 5, 32, 431/200, 121, 190, 352, 353; 432/2, 75; 422/168, 173; 196/122; 110/213, 236, 235, 238

(56) References Cited

U.S. PATENT DOCUMENTS

| | | | | |
|---|---|---|---|---|
| 319,270 | * | 6/1885 | Lanyon | 196/122 |
| 1,624,865 | * | 4/1927 | Freel | 196/122 |
| 1,796,878 | * | 3/1931 | Watson | 196/122 |
| 2,655,455 | * | 10/1953 | Steele | 196/122 |
| 3,875,874 | * | 4/1975 | Altmann | 110/213 |
| 4,402,738 | * | 9/1983 | Akio | 110/213 |
| 4,438,706 | * | 3/1984 | Boday et al. | 110/238 |
| 4,509,434 | * | 4/1985 | Boday et al. | 110/238 |
| 4,555,389 | | 11/1985 | Soneta et al. . | |
| 4,768,949 | * | 9/1988 | Goodfellow | 431/190 |
| 4,974,530 | * | 12/1990 | Lyon | 110/213 |
| 5,181,475 | * | 1/1993 | Breen et al. | 110/213 |
| 5,588,381 | * | 12/1996 | Jennebach et al. | 110/213 |
| 5,603,905 | * | 2/1997 | Bartz et al. | 431/7 |
| 5,693,293 | * | 12/1997 | Reichardt et al. | 431/5 |
| 5,724,901 | * | 3/1998 | Guy et al. | 431/5 |
| 5,749,720 | * | 5/1998 | Fukuda et al. | 431/353 |
| 5,759,498 | * | 6/1998 | Sheu et al. | 422/168 |
| 5,800,792 | * | 9/1998 | Ibaraki et al. | 422/168 |
| 5,855,742 | * | 1/1999 | Lumbroso et al. | 196/122 |
| 5,938,422 | * | 8/1999 | Smith et al. | 431/5 |

FOREIGN PATENT DOCUMENTS

| | | |
|---|---|---|
| 0 160 524 | 6/1985 | (EP) . |
| 63-62528 | 3/1988 | (JP) . |
| 2-68414 | 3/1990 | (JP) . |
| 2-103311 | 4/1990 | (JP) . |
| 2-126014 | 5/1990 | (JP) . |

* cited by examiner

*Primary Examiner*—Ira S. Lazarus
*Assistant Examiner*—David Lee
(74) *Attorney, Agent, or Firm*—Armstrong, Westerman, Hattori, McLeland & Naughton, LLP

(57) ABSTRACT

A combustion type detoxifying apparatus which carries out detoxifying treatment of a raw gas containing toxic components injected through a burner (2) into a combustion chamber (1) by allowing the toxic components to burn or undergo pyrolysis. The combustion chamber (1) having a double-wall structure consisting of an outer barrel (11) and an inner barrel (12) which is made of a porous material. The combustion chamber (1) is provided with a gas introducing nozzle (4) for introducing a pressure gas to the space defined between the outer barrel (11) and the inner barrel (12).

7 Claims, 4 Drawing Sheets

COMBUSTION TYPE HARMFUL SUBSTANCE REMOVING APPARATUS

TECHNICAL FIELD

The present invention relates to a combustion type detoxifying apparatus, more particularly to the structure of a combustion chamber in a gas treating apparatus for detoxifying toxic components such as toxic gases, combustible gases and corrosive gases which are contained in raw gases such as exhaust gases to be exhausted from systems for producing semiconductors or LCDs by allowing such components to burn or undergo pyrolysis.

BACKGROUND ART

Since gases containing combustible or combustion-assisting toxic components are exhausted as exhaust gases from systems for producing semiconductors or LCDs, these exhaust gases should be subjected to treatments for removing such toxic components (detoxifying treatment) before they are exhausted. A combustion type detoxifying apparatus is known as an apparatus for carrying out such detoxifying treatment of exhaust gases.

This combustion type detoxifying apparatus, which carries out detoxifying treatment by allowing various kinds of toxic components contained in an exhaust gas to burn or undergo pyrolysis, has a structure in which the exhaust gas, a combustion assisting gas, etc. injected through a burner into a combustion chamber are burned.

Powdery solid oxides are formed occasionally when exhaust gases are subjected to combustion treatment in this combustion type detoxifying apparatus, and the solid oxides formed deposit on the inner surface of the combustion chamber to be liable to affect the combustion treatment.

Accordingly, the conventional combustion chambers are allowed to have large capacities compared with the amounts of exhaust gases to be treated so as to reduce the influence of the deposit or are provided with means for mechanically scraping off the solid oxides deposited.

However, the increase in the size of the combustion chamber leads to rise in the equipment cost and enlargement of the apparatus inconveniently. Further, in the case where the combustion chamber is provided with the scraping means, the constitution of the apparatus is complicated, leading not only to further increase in the equipment cost but also to difficulties in the maintenance of the apparatus.

It is an objective of the present invention to provide a combustion type detoxifying apparatus which can securely prevent powders of solid oxides and the like from depositing on the inner surface of the combustion chamber at a low cost.

DISCLOSURE OF THE INVENTION

In the combustion type detoxifying apparatus according to the present invention, which carries out detoxifying treatment of a raw gas containing toxic components injected through a burner into a combustion chamber by allowing the toxic components to burn or undergo pyrolysis, the combustion chamber has a double-wall structure consisting of an outer barrel and an inner barrel which is made of a porous material, and the combustion chamber also has gas introducing means for introducing a pressure gas to the space defined between the outer barrel and the inner barrel.

According to this constitution, since the pressure gas introduced to the space defined between the outer barrel and the inner barrel bursts into the combustion chamber through the pores of the porous material constituting the inner barrel, the bursting power of the pressure gas prevents solid oxides and other powders occurring during combustion treatment of the raw gas from depositing on the inner surface of the inner barrel. Thus, deposition of powders such as solid oxides on the inner surface of the combustion chamber can be prevented inexpensively by use of a simple structure without requiring a large installation space, and detoxifying treatment can be carried out in a stable state over an extended period.

The improved combustion chamber according to the present invention is further provided with liquid supply means for supplying a liquid to the inner surface of the inner barrel. Thus, since powders depositing at welded portions and the like in the combustion chamber can be removed easily, there is substantially no need of disassembling the apparatus for removing the powders, and the maintenance cost can be reduced on a great margin.

Further, according to the present invention, a raw gas introducing passage for introducing a raw gas to the burner has a branch passage which is provided with detoxification treatment means, and a selector valve, which carries out selection between the passage to the burner and the passage to the detoxification treatment means, is disposed at a junction of the raw gas introducing passage and the branch passage. According to this constitution, since detoxifying treatment of the raw gas can be carried on even when the detoxifying treatment in the combustion chamber is interrupted, the operation of the raw gas supply source such as a semiconductor producing system need not be stopped, avoiding occurrence of defectives and reduction of productivity.

Meanwhile, according to the present invention, since a detoxifying column packed with a detoxifying agent which carries out detoxifying treatment of the toxic components under treatment by means of adsorption and the like is used as the detoxification treatment means, not only the equipment cost and the running cost can be reduced, but also the space for installing the detoxifying treatment means can be minimized. Such detoxifying column can be easily attached to existing equipments.

Further, the apparatus according to the present invention is provided with a purge gas introducing passage for purging the raw gas remaining in the burner and combustion chamber toward the detoxification treatment means. Thus, since toxic components and combustible components in the burner and combustion chamber can be purged without stopping the operation of the raw gas supply source such as a semiconductor producing system, no toxic component is released even when the burner and the combustion chamber are disassembled for inspection, and operators can work safely.

BEST MODE FOR CARRYING OUT THE INVENTION

Figure 1:
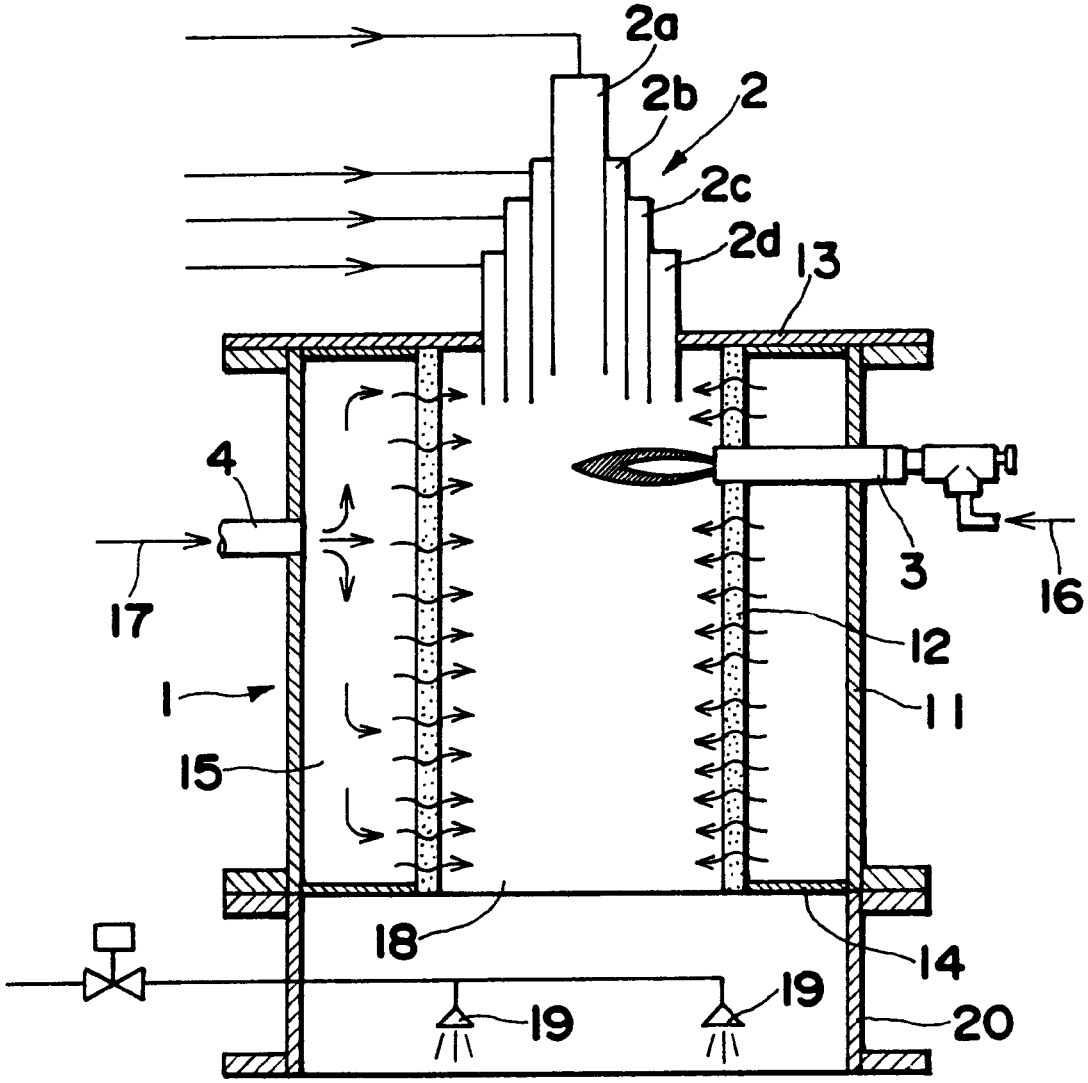
FIG. 1 is a cross-sectional view showing a combustion type detoxifying apparatus according to a first embodiment of the present invention.

Embodiments of the present invention will be described below more specifically referring to the drawings.

A combustion type detoxifying apparatus according to a first embodiment contains a combustion chamber 1, a burner 2 provided at the center of the top of the combustion chamber 1, an igniting pilot burner 3 disposed in the combustion chamber 1 and a gas introducing nozzle 4 as gas introducing means.

The combustion chamber 1 has a double-wall structure containing a cylindrical outer barrel 11 made of an ordinary metallic material and the like and a cylindrical inner barrel 12 made of a porous material which are arranged concentrically. The combustion chamber 1 has a blocking plate 13 at the top and another blocking plate 14 at the bottom and between the outer barrel 11 and the inner barrel 12.

The outer barrel 11 and the blocking plates 13,14 may be made of any material so long as it has a predetermined heat resistance and a predetermined strength and it can be joined securely at junctions by welding, flange coupling, etc. The porous material employable for the inner barrel 12 may not be particularly limited so long as it satisfies the heat resistance and strength requirements, and there may be employed a sintered ceramic body, a sintered metal or the like having fine pores uniformly throughout the material regardless of the pore size or mesh size. The clearance between the outer barrel 11 and the inner barrel 12 is of such a degree that a pressure gas to be introduced into a space 15 defined between them can be distributed uniformly over the entire wall surface of the inner barrel 12 and can be adjusted suitably depending on the size of the combustion chamber 1, conditions under which the pressure gas is introduced, the location of the gas introducing nozzle 4, the number of nozzles 4 installed, etc.

The pilot burner 3 is attached to the wall of the combustion chamber 1 at an upper position to penetrate the outer barrel 11 and the inner barrel 12. The pilot burner 3 is of the conventional type having a sparking plug, and a mixed gas of a fuel and a combustion assisting gas, e.g., a propane gas and air, supplied through a passage 16 is ignited with the sparking plug to be burned and to light up a gas injected from the burner 2.

The gas introducing nozzle 4, which is attached to the outer barrel 11, introduces the pressure gas such as compressed air to be supplied through a passage 17 into the space 15. A plurality of gas introducing nozzles 4 may be incorporated depending on the size of the combustion chamber 1 and the like, and locations of the nozzles 4 are not limited. Further, a baffle plate may be disposed to oppose the tip of each nozzle 4 so that the pressure gas may be diffused uniformly throughout the space 15.

The pressure gas may be of any gas such as air and an inert gas, which is compressed to a suitable pressure, so long as it does not affect the combustion treatment to be carried out in the combustion chamber 1 ie., it does not contain a fuel gas. Further, the feed pressure and feed amount of the pressure gas are not limited, and they can be suitably set at levels, taking also the strength of the apparatus, the cost of supplying the pressure gas, etc. into consideration, such that the gas can pass the pores of the inner barrel 12, that the combustion treatment may not be affected and that deposition of powders on the inner surface of the inner barrel 12 can be controlled.

The combustion chamber 1 has a lower opening 18 which is connected to an exhaust gas treating system (not shown) via a chamber 20 containing spray nozzles 19 for spraying a coolant for cooling the combustion gas.

The burner 2 is of a quadruple-wall pipe structure consisting of a lift gas channel 2*b* to which nitrogen gas etc. is supplied, a primary air channel 2*c* to which combustion air and the like is supplied and a channel 2*d* to which secondary air or nitrogen gas etc. is supplied, which are formed concentrically in this order around a raw gas channel 2*a* to which a raw gas is supplied. Burners of various structures employable for combustion treatment of raw gases may be used as the burner 2 and the pilot burner 3, and those having appropriate structures are selected and used depending on the raw gas components and the amount of the raw gas to be treated.

By forming the inner barrel 12 of the combustion chamber 1 using a porous material and by introducing a pressure gas into the space 15 defined between the outer barrel 11 and the inner barrel 12 as described above, the pressure gas bursts onto the inner surface of the inner barrel 12 through the pores of the porous material, so that solid oxides and other powders occurring during combustion treatment of the raw gas are prevented by the bursting power of the gas from depositing on the inner surface of the inner barrel 12.

Thus, even if powdery solid oxides are formed during combustion treatment of the raw gas or if powders are carried on the raw gas, such powders do not deposit on the inner surface of the inner barrel 12, enabling stable combustion treatment over a long period.

Further, the combustion chamber 1 can be downsized since powders are prevented from depositing on the inner surface of the inner barrel 12, and the structure of the combustion chamber 1 is simple, since it may be merely allowed to have a double-wall structure and also to have a gas introducing nozzle 4 for introducing a pressure gas, leading to reduction in the equipment cost and the running cost.

Next, a combustion type detoxifying apparatus according to a second embodiment shown in FIG. 2 will be described.

In this combustion type detoxifying apparatus, deposit-removing spray nozzles 5 are provided at the top of the combustion chamber 1 and within the inner barrel 12, as means for supplying a liquid such as water to the inner surface of the inner barrel 12. A baffle plate 6 is disposed to oppose the tip of the gas introducing nozzle 4. This baffle plate 6 is provided so as to diffuse the pressure gas introduced through the nozzle 4 throughout the space 15 defined between the outer barrel 11 and the inner barrel 12. A flame detector 7 for confirming the state of flame in the combustion chamber 1 via the pilot burner 3 is disposed at the rear end of each pilot burner 3. A burner 21 is attached to the combustion chamber 1 via a pre-combustion chamber 8. Other constituents are substantially the same as the counterparts in the combustion type detoxifying apparatus of the first embodiment shown in FIG. 1.

It should be noted that the burner 21 has a quintuple-wall pipe structure consisting of a lift gas channel, a raw gas combustion assisting gas channel, a fuel gas combustion assisting gas channel and a fuel gas channel, which are formed concentrically around a raw gas channel.

Actions of the thus constituted combustion type detoxifying apparatus will be described below.

According to the structure of the combustion type detoxifying apparatus of the first embodiment shown in FIG. 1, powders are prevented from depositing on the inner surface of the inner barrel 12. However, the pilot burners 3 penetrating the inner barrel 12, a temperature detector (not shown) and other parts to be attached to the inner barrel 12 are fixed at the front ends respectively to the inner barrel 12 by means of welding. Accordingly, this welding treatment blocks pores of the porous material constituting the inner barrel 12 at welded portions 9, and the porous state is impaired at the portions 9 to prevent the pressure gas from bursting therethrough, so that powders can deposit at the welded portions 9 on the inner surface as the combustion treatment progresses.

Although such deposition of powders at these welded portions 9 is not generally of a degree that affects the combustion treatment, it is desirable to remove the powders deposited at the welded portions 9 on the standpoint of preventing troubles over an extended period. Further, as shown in FIG. 2, when the combustion chamber is provided at the bottom with the spray nozzles 19 for spraying a coolant for cooling the combustion gas, powders also deposit on the upper surface of each coolant spray nozzle 19 and that of a coolant supply pipe 22 in the chamber 20, so that such powders are also removed desirably.

For such reasons, the deposit-removing spray nozzles 5 are provided in the inner barrel 12 of the combustion chamber 1 to spray therefrom a liquid such as water and an aqueous alkali solution against the inner surface of the inner barrel 12, particularly against the welded portions 9, and thus the powders deposited at the welded portions 9 and on the coolant spray nozzles 19 and the like can be removed easily without disassembling the apparatus.

As liquid supply means for supplying a liquid to the inner surface of the inner barrel 12, while it may be one which supplies the liquid such that it may flow down along the inner surface of the inner barrel 12, use of the deposit-removing spray nozzles 5 which spray a liquid with an appropriate power enables efficient removal of the powders with the aid of the impact force of the liquid sprayed. Various types of nozzles including full corn type, flat type, etc. may be employed as the deposit-removing spray nozzles 5, and the number and locations of the nozzles 5 may be suitably selected depending on the size of the combustion chamber 1 or the number or locations of the welded portions 9. Further, the direction of spraying the liquid can be set as desired.

Further, when the combustion chamber 1 is provided at the bottom with the coolant spray nozzles 19, a pipe branching from the coolant supply pipe 22 may be connected to the deposit-removing spray nozzles 5. Meanwhile, use of an aqueous alkali solution and the like as the liquid to be sprayed depending on the properties of powders deposited further ensures removal of the powders.

The removal of powders using water and the like is carried out after the operation of the apparatus is interrupted and the inner barrel 12 is cooled to a predetermined temperature or lower. Accordingly, means for measuring the temperature of the inner barrel 12 and an automatic valve which opens only when the temperature of the inner barrel 12 is at the predetermined temperature or lower based on signals from the temperature measuring means are incorporated so as to prevent water and the like from being supplied to the deposit-removing spray nozzle 5 when the inner barrel 12 under operation is at a high temperature.

Next, a combustion type detoxifying apparatus according to a third embodiment shown in FIG. 3 will be described.

Figure 2:
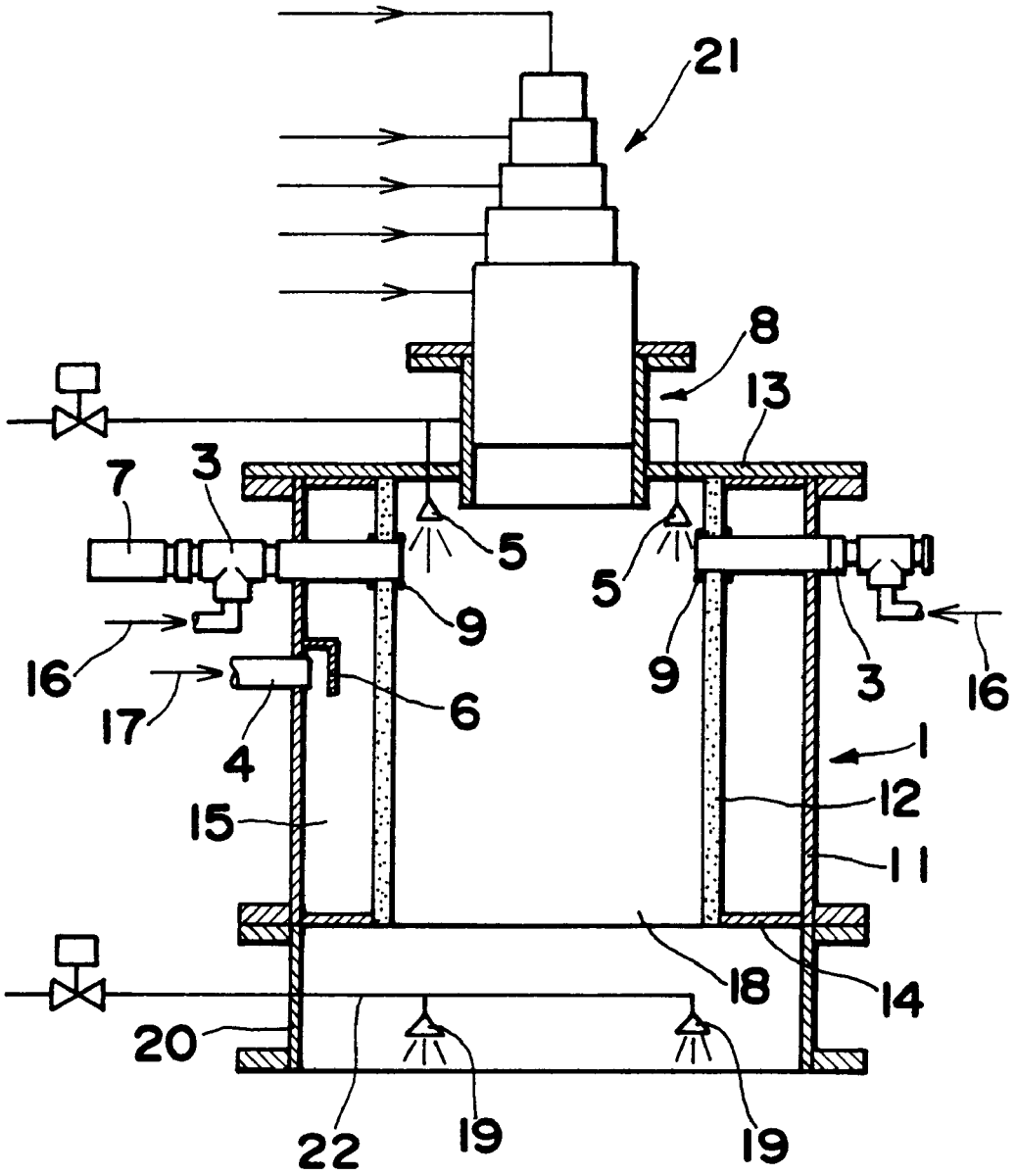
FIG. 2 is a cross-sectional view showing a combustion type detoxifying apparatus according to a second embodiment of the present invention.

This combustion type detoxifying apparatus contains a combustion type detoxifying apparatus having substantially the same constitution as that of the second embodiment shown in FIG. 2. More specifically, a combustion chamber 1, an igniting pilot burner 3, a gas introducing nozzle 4, deposit-removing spray nozzles 5, a baffle plate 6, a pre-combustion chamber 8, an outer barrel 11, an inner barrel 12, blocking plates 13 and 14, a space 15 to be defined between the outer barrel 11 and the inner barrel 12, a chamber 20 which contains coolant spray nozzles 19 and is connected to a lower opening 18 of the combustion chamber 1, a burner 21, etc. have substantially the same constitutions as those of the counterparts shown in FIG. 2.

The reference number 23 denotes a raw gas introducing passage which introduces a raw gas exhausted from a raw gas supply source (not shown) such as a semiconductor producing system and the like. The raw gas introducing passage 23 is diverged at a junction 24 into a main passage 25 through which the raw gas is supplied to the burner 21 and a branch passage 26.

The main passage 25 is connected to a raw gas channel of the burner 21. A lift gas introducing passage 27, a raw gas combustion assisting gas introducing passage 28, a fuel gas combustion assisting gas introducing passage 29 and a fuel introducing passage 30 are connected to a lift gas channel, a raw gas combustion assisting gas channel, a fuel gas combustion assisting gas channel and a fuel gas channel of the burner 21, respectively.

A coolant supply pipe 22 for supplying a coolant to the coolant spray nozzles 19 is provided with a solenoid valve 31. A branch pipe 32 branching from the coolant supply pipe 22 on the upstream side of the solenoid valve 31 is connected via another solenoid valve 33 to the deposit-removing spray nozzles 5.

The chamber 20 is provided at the bottom with a cylindrical exhaust chamber 34 having a closed bottom. The exhaust chamber 34 is provided with a treated gas exhaust passage 37 having a water-sealed vacuum pump 35 and a gas-liquid separator 36 and with a purge gas introducing passage 38 for purging the gas in the combustion chamber 1, pre-combustion chamber 8 and burner 21. The reference number 39 denotes a valve attached to the purge gas introducing passage 38.

A selector valve for selecting a raw gas passages is disposed at the junction 24 of the raw gas introducing passage 23. In this embodiment, a selector valve 40 and a selector valve 41 are attached to the main passage 25 and the branch passage 26 respectively. The branch passage 26 is connected via the selector valve 41 to detoxification treatment means 42. An exhaust passage 43, which is connected to the detoxification treatment means 42, is combined with the treated gas exhaust passage 37.

The detoxification treatment means 42 in this embodiment is a detoxifying column packed with a dry detoxifying agent which achieves detoxification by adsorbing toxic components contained in a raw gas or by chemical reactions with such components, for example, a detoxifying agent containing cupric hydroxide or a copper oxide as a major component. The treated gas obtained after detoxifying treatment in the detoxifying column is exhausted through the exhaust passage 43.

In the normal running state, the selector valve 40 of the main passage 25 is open; the selector valve 41 of the branch passage 26 is closed; the solenoid valve 33 of the deposit-removing spray nozzles 5 is closed; the solenoid valve 31 of the coolant spray nozzles 19 is open; and the valve 39 of the purge gas introducing passage 38 is closed. A raw gas containing toxic components, a lift gas, a raw gas combustion assisting gas, a fuel gas combustion assisting gas and a fuel are supplied to the respective channels of the burner 21 from the main passage 25, lift gas introducing passage 27, raw gas combustion assisting gas introducing passage 28, the fuel gas combustion assisting gas introducing passage 29 and fuel introducing passage 30, respectively. The gas injected from the burner 21 is ignited by a pilot flame of the pilot burner 3.

Thus, the toxic components in the raw gas are detoxified by burning or pyrolysis in the flames of the burner 21, and solid oxides occurring during combustion are inhibited from depositing on the inner surface of the inner barrel 12 by the compressed air bursting through the porous material constituting the inner barrel 12 and flow downward together with the combustion gas into the chamber 20. The combustion gas and the like flowed down into the chamber 20 are cooled by the coolant sprayed through the spray nozzles 19, sucked together with the solid oxides and coolant by the vacuum pump 35 from the exhaust chamber 34, separated from the coolant and the like in the gas-liquid separator 36 and exhausted through the treated gas exhaust passage 37. Meanwhile, the solid oxides suspended in the coolant under the stirring action of the vacuum pump 35 are extracted together with the coolant from the gas-liquid separator 36 to a passage 44 and are subjected to post-treatment including solid-liquid separation and the like.

As described above, the detoxifying treatment in this embodiment is designed to be carried out only by the combustion treatment in the combustion chamber 1 in the normal running state.

When solid oxides deposited on the inner surface of the inner barrel 12 of the combustion chamber 1 are to be removed, the combustion operation is interrupted after the selector valve 41 is opened and the selector valve 40 is closed so that no untreated toxic components may remain in the main passage 25, burner 21, pre-combustion chamber 8, combustion chamber 1, chamber 20, exhaust chamber 34, etc. which locate on the downstream side of the selector valve 40. The selector valve 40 may be closed by selecting the timing when the amount of toxic components in the raw gas flowing through the raw gas introducing passage 23 becomes small depending on the running state of the semiconductor producing system and the like, or after the concentration of toxic components flowing into the combustion chamber 1 and the like is reduced by introducing a diluent gas to the raw gas introducing passage 23 to an appropriate position from a diluent gas introducing passage 45. In any case, the toxic components may be adapted not to remain in the combustion chamber 1 beyond a specified concentration.

After it is detected by a temperature sensor (not shown) that the internal temperature of the combustion chamber 1 is lowered sufficiently, water and the like is sprayed from the deposit-removing spray nozzles 5 to remove the deposit present on the inner surface of the inner barrel 12. In the meantime, the raw gas containing toxic components exhausted from a semiconductor producing system or the like flows from the raw gas introducing passage 23 into the branch passage 26, and after it is detoxified by the detoxifying agent in the detoxification treatment means 42, the resulting treated gas is exhausted through the exhaust passage 43.

Accordingly, since detoxifying treatment of the raw gas can be carried on by the detoxification treatment means 42 even while the combustion chamber 1 is subjected to the treatment of removing the deposit or other maintenance operation, running of the raw gas supply source such as a semiconductor producing system etc. can be continued, leading to a great increase in productivity.

Further, in an emergency of stopping operation of the combustion chamber 1 due to any abnormality in its operation of detoxifying treatment, the vacuum pump 35 is stopped immediately and also the selector valve 41 of the branch passage 26 is opened to introduce the raw gas into the detoxification treatment means 42, in order to prevent the toxic components from being exhausted through the treated gas exhaust passage 37. The valve 39 is then opened, in order to exhaust the toxic components remaining in the main passage 25, burner 21, pre-combustion chamber 8, combustion chamber 1, chamber 20, exhaust chamber 34, etc. locating on the downstream side of the selector valve 40, to introduce a purge gas such as nitrogen gas through the purge gas introducing passage 38 into the combustion chamber 1 against the flow of the raw gas and to allow the gas containing toxic components to flow toward the branch passage 26 and to be introduced to the detoxification treatment means 42 where it is subjected to detoxifying treatment. After sufficient purging treatment in the combustion chamber 1, the selector valve 40 is closed, and the valve 39 is also closed.

Thus, since the toxic components and combustible components in the combustion chamber 1 are purged out, disassembling and inspection of the burner, combustion chamber, etc. can be carried out safely without interrupting the operation of the raw gas supply source such as a semiconductor producing system.

In carrying out this purging treatment, the purge gas introducing passage 38 may be omitted, and instead a purge gas can be introduced into the combustion chamber 1 through the burner 21, the gas introducing nozzle 4 or the like. However, the purge gas introduced through the purge gas introducing passage 38 into the combustion chamber 1 from the downstream side thereof purges the toxic components etc. present in the combustion chamber 1 efficiently toward the detoxification treatment means 42.

Further, since the detoxifying treatment of the exhaust gas can be carried on in the detoxification treatment means 42, as described above, for example, a semiconductor producing system which is the raw gas supply source need not be stopped, and film-forming treatment for wafers under treatment can be completed to form no defective wafers, obviating loss of wafers.

Incidentally, detoxifying treatment in the detoxification treatment means 42 can further be ensured by introducing a diluent gas through the diluent gas introducing passage 45 to lower the concentration of toxic components depending on the treating capacity of the detoxifying agent. Further, when a semiconductor producing system and the like is operated employing no poisonous component or toxic component, for example, in the state where the composition of the raw gas is nitrogen and hydrogen, a diluent gas such as nitrogen gas may be introduced through the diluent gas introducing passage 45 to lower the hydrogen concentration, and the raw gas merely subjected to such treatment can be released to the atmosphere.

Further, the detoxifying column employed as the detoxification treatment means 42 may be replaced with other detoxifying means, for example, a well-known wet type detoxifier. However, the detoxifying column packed with a dry detoxifying agent described above can be embodied by providing a packing column, a simple piping and a valve and requires no operation of heating, cooling, liquid circulation, etc. for carrying out the detoxifying treatment, thus no extra utility, and the detoxifying treatment can be carried out by merely introducing an exhaust gas. Accordingly, the detoxifying column is most suitable as auxiliary means which supports the detoxification treatment of the combustion chamber 1. Particularly, use of cupric hydroxide as the dry detoxifying agent enables efficient and secured detoxification of various kinds of toxic components employed in the semiconductor producing system etc.

While automatic valves which open and close automatically depending on the flow rate or temperature of the respective sections are employed as the valves incorporated in the respective passages, and if a valve which closes at service interruption and a valve which opens at service interruption are employed as the selector valve 40 of the main passage 25 and the selector valve 41 of the branch passage 26 respectively, the raw gas can be introduced instantaneously to the detoxification treatment means 42 even if service interruption occurs to carry on the detoxifying treatment there, enhancing safety.

Incidentally, the pre-combustion chamber and burner may have desired structures and shapes respectively, and those conventionally used can be also employed.

Test examples based on the above embodiments will be described below.

Test Example 1

Figure 4:
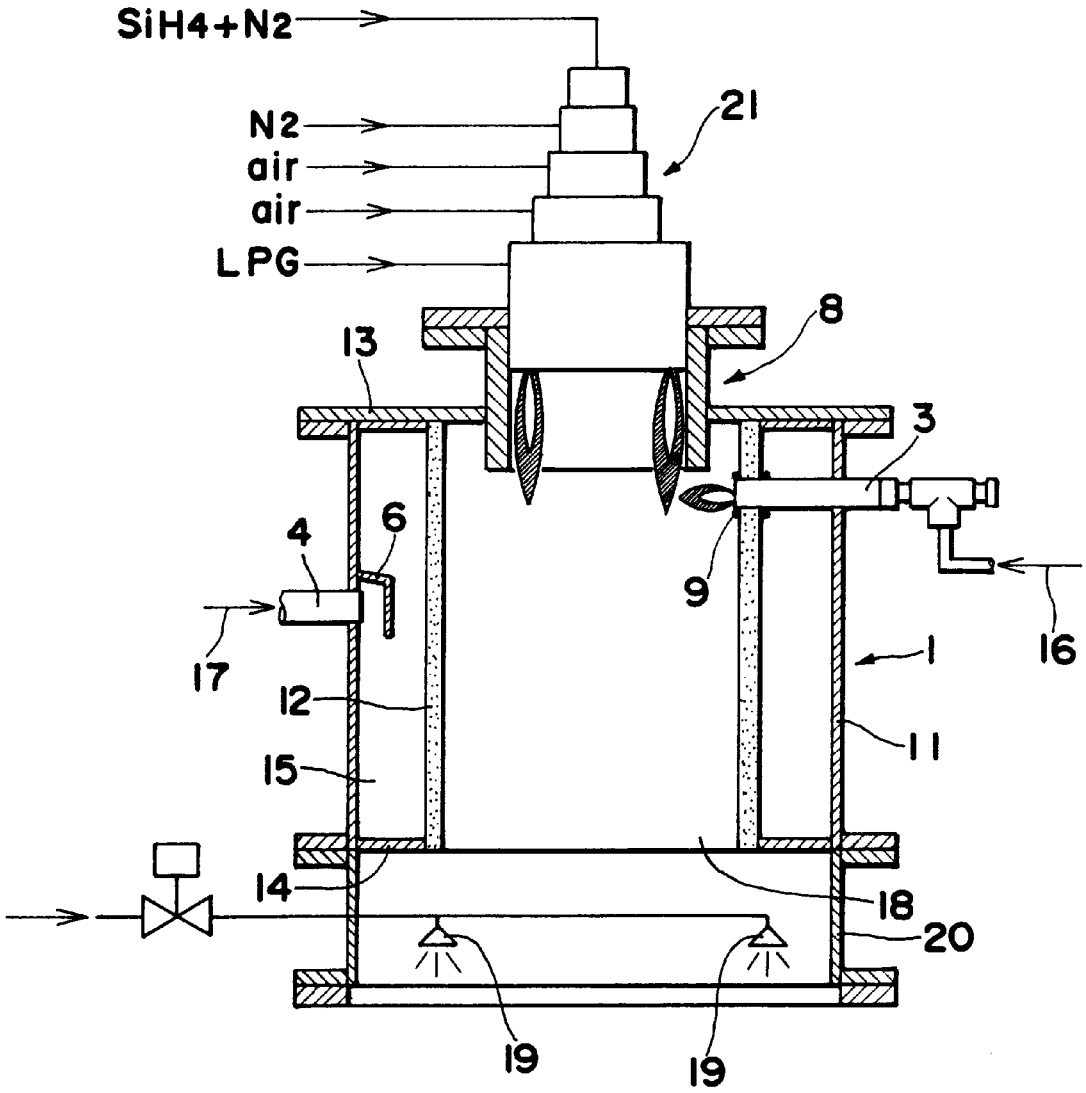
FIG. 4 is a cross-sectional view showing a combustion type detoxifying apparatus employed in Test Example 1.

Detoxifying treatment for removing silane was carried out employing a combustion type detoxifying apparatus having a structure shown in FIG. 4. A combustion chamber 1 in this combustion type detoxifying apparatus has a double-wall structure having a height of 300 mm, consisting of a stainless steel outer barrel 11 having an outside diameter of 216.3 mm and an inner barrel 12 which is made of a sintered metal of stainless steel and has an outside diameter of 150 mm, a thickness of 3 mm and a nominal filtration accuracy of 100 $\mu$m. A diffusion type burner 21 having a quintuple-wall pipe structure was provided, via a pre-combustion chamber 8, at the center of the top of the combustion chamber 1. A pilot burner 3 was attached to the wall of the combustion chamber 1 at an upper position. The lower opening 18 of the combustion chamber 1 was connected to an exhaust gas treating system (not shown) via a chamber 20 having spray nozzles 19 for spraying a coolant for cooling the combustion gas.

Gases were supplied to the burner 21: nitrogen gas ($N_2$) containing 3% of silane ($SiH_4$) to the raw gas channel formed at the center at a rate of 150 lit/min; nitrogen gas ($N_2$) to the lift gas channel formed around the raw gas channel at a rate of 10 lit/min; air to the silane combustion assisting gas channel formed around the lift gas channel at a rate of 100 lit/min; air to the fuel combustion assisting gas channel formed around the silane combustion assisting gas channel at a rate of 125 lit/min; and propane gas (LPG) to the fuel channel formed around the fuel combustion assisting gas channel at a rate of 5 lit/min, respectively.

To the pilot burner 3 was supplied a gas formed by mixing 1 lit/min of propane gas and 22 lit/min of air. To the space 15 defined between the outer barrel 11 and the inner barrel 12 was supplied compressed air having a pressure of 4 kg/cm$^2$G from a gas introducing nozzle 4 at a rate of 165 lit/min. Incidentally, a baffle plate 6 was disposed in front of the tip of the gas introducing nozzle 4.

After the apparatus was operated under the above-described conditions for 8 hours, the combustion chamber 1 was opened for inspection of the inside thereof, and there was observed no deposit of powders on the inner surface of the inner barrel 12. Meanwhile, the silane concentration in the gas exhausted from the exhaust gas treating system was constantly less than 1/10 of the threshold limit value 5 ppm throughout the operation.

Comparative Example

Detoxifying treatment for removing silane was carried out in the same manner as in Test Example 1, except that an inner barrel made of stainless steel and having an outside diameter of 165.2 mm was employed and that introduction of compressed air through the gas introducing nozzle 4 was stopped. When the inside of the combustion chamber was inspected after the apparatus was operated for 8 hours, a powder ($SiO_2$) deposited on the inner surface of the inner barrel to a thickness of 5 to 6 cm.

Test Example 2

When the inside of the combustion chamber 1 was inspected after the combustion type detoxifying apparatus having the structure as shown in FIG. 4 was operated continuously for 168 hours under the same conditions as in Test Example 1, a powder ($SiO_2$) deposited around the welded portion 9 of the pilot burner 3 and on the upper surface of each coolant spray nozzle 19 to a thickness of 15 to 20 mm. It should be noted here that, even in this case, the silane concentration in the gas exhausted from the exhaust gas treating system was constantly less than 1/10 of the threshold limit value 5 ppm throughout the operation.

Then, three deposit-removing spray nozzles for spraying water against the inner surface of the inner barrel 12 were attached to the top of the combustion chamber 1 and within the inner barrel, as shown in FIG. 2.

Combustion treatment was carried out continuously for 168 hours, and after the temperature of the inner barrel 12 was lowered to 50° C. or lower, water was sprayed from the spray nozzles against the inner surface of the inner barrel 12 for 10 minutes.

Subsequently, when the combustion chamber 1 was opened for inspection of the inside thereof, there was observed no deposition of powders, of course, on the inner surface of the inner barrel 12, and also around the welded portion 9 of the pilot burner 3 and on the upper surface of each coolant spray nozzle 19.

Test Example 3

Figure 3:
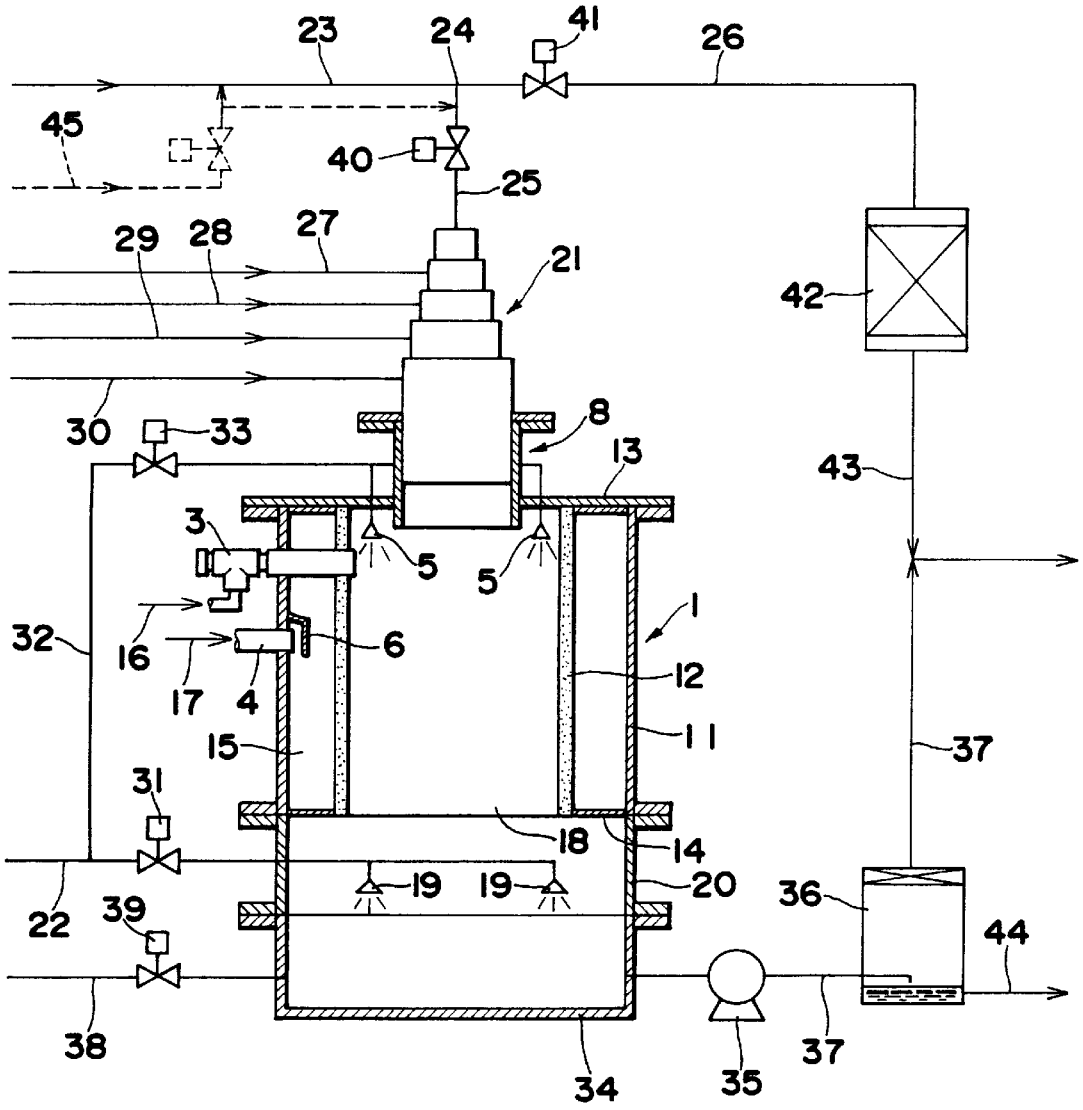
FIG. 3 is a system chart showing a combustion type detoxifying apparatus according to a third embodiment of the present invention.

An apparatus having the constitution as shown in FIG. 3 was employed, and a detoxifying column packed with a detoxifying agent containing cupric hydroxide as a major component was employed as the detoxification treatment means 42. A sample nitrogen gas containing 3% of silane was employed as the raw gas corresponding to the exhaust gas to be exhausted from a semiconductor producing system or the like. Combustion detoxifying treatment was carried out by injecting the sample gas from the burner 21 at a rate of 150 lit/min into the combustion chamber 1. In this treatment, the silane concentration in the treated gas exhausted from the treated gas exhaust passage 37 was less than 1/10 of the threshold limit value 5 ppm.

After 3 hours, the selector valve 41 was opened, and the selector valve 40 was closed to introduce the sample gas through the branch passage 26 into the detoxification treatment means 42 where it was subjected to detoxifying treatment.

In this case, the burning operation of the burner 21 was stopped after 30 minutes from the closing of the selector valve 40 taking the time until the sample gas remaining in the selector valve 40 throughout the exhaust chamber 34 disappears into consideration. When the internal temperature of the combustion chamber 1 dropped to 50° C. or lower, water was sprayed from the deposit-removing spray nozzles 5 to remove the deposit present on the inner surface of the inner barrel 12. Subsequently, the selector valve 40 was opened, and the gas injected from the pilot burner 3 and that from the burner 21 were ignited. At the time point when the internal temperature of the combustion chamber 1 became higher than 200° C., the selector valve 41 was closed to resume detoxifying treatment by the combustion chamber 1.

The silane concentration in the gas exhausted from the detoxification treatment means 42 into the exhaust passage 43 until the combustion chamber 1 resumed detoxifying treatment: was less than 1/10 of the threshold limit value throughout the operation.

Test Example 4

While combustion detoxifying treatment was being carried out in the combustion chamber 1 in the same manner as in Example 3 employing nitrogen gas containing 3% of silane as the sample gas, combustion at the burner 21 was stopped suddenly, and the selector valve 41 of the branch passage 26 was opened simultaneously to start detoxifying treatment in the detoxification treatment means 42. The vacuum pump 35 was stopped substantially at the same time, and the pilot burner 3 was also extinguished.

The valve 39 of the purge gas introducing passage 38 was opened to introduce nitrogen gas into the combustion chamber 1 at a rate of 300 lit/min so as to allow the gas in the combustion chamber to flow back toward the detoxification treatment means 42. No silane was detected in the gas in the combustion chamber 1 after this purging with nitrogen gas was carried out for 30 minutes. Further, the combustion chamber 1 could resume detoxifying treatment smoothly.

The silane concentration in the gas exhausted from the toxification treatment means 42 into the exhaust passage 43 from the emergency stop of the operation of detoxifying treatment by the combustion chamber 1 until the combustion chamber 1 resumed detoxifying treatment was less than 1/10 of the threshold limit value like in test example 3.

What is claimed is:

1. A combustion detoxifying apparatus which carries out a detoxifying treatment of a raw gas containing silane by allowing the silane to burn or undergo pyrolysis, comprising a combustion chamber having a double-wall structure, consisting of an outer barrel and an inner barrel which is entirely made of a porous material;

the combustion chamber having a burner connected to a source of raw gas and to a source of combustion assisting gas and opening into the inner barrel, for injecting a raw gas containing silane and a combustion assisting gas into the combustion chamber;

the combustion chamber also having means for introducing a pressure gas which does not contain a fuel gas into a space defined between the outer barrel and the inner barrel during operation of the detoxifyng apparatus.

2. The combustion detoxifying apparatus according to claim 1, wherein the combustion chamber is provided with liquid supply means for supplying a liquid to an inner surface of the inner barrel.

3. The combustion detoxifying apparatus according to claim 1, wherein a raw gas introducing passage for introducing the raw gas to the burner has a branch passage which is provided with detoxification treatment means; with a selector valve, which carries out selection between the passage to the burner and the passage to the detoxification treatment means, being disposed at a junction of the raw gas introducing passage and the branch passage.

4. The combustion detoxifying apparatus according to claim 3, wherein the detoxification treatment means is a detoxifying column packed with a detoxifying agent which carries out detoxifying treatment of the toxic components under treatment.

5. The combustion detoxifying apparatus according to claim 3, further comprising a purge gas introducing passage for purging the raw gas remaining in the burner and combustion chamber toward the detoxification treatment means.

6. The combustion detoxifying apparatus according to claim 4, wherein the detoxification treatment means carries out detoxifying treatment of the silane by adsorption.

7. The combustion detoxifying apparatus according to claim 1, wherein the source of pressure gas which does not contain a fuel gas is a source of pressurized air or pressurized inert gas.

* * * * *